US006240757B1

(12) United States Patent
Brüstle et al.

(10) Patent No.: US 6,240,757 B1
(45) Date of Patent: Jun. 5, 2001

(54) PROCESS AND INSTALLATION FOR ROLLING A METAL STRIP

(75) Inventors: Roland Brüstle, Neunkirchen; Eckhard Wilke, Marloffstein, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/462,657

(22) PCT Filed: Jun. 26, 1998

(86) PCT No.: PCT/DE98/01771

§ 371 Date: Mar. 17, 2000

§ 102(e) Date: Mar. 17, 2000

(87) PCT Pub. No.: WO99/02281

PCT Pub. Date: Jan. 21, 1999

(30) Foreign Application Priority Data

Jul. 11, 1997 (DE) ..... 197 29 773

(51) Int. Cl.[7] ..... B21B 37/00

(52) U.S. Cl. ..... 72/9.2; 72/7.6; 72/11.8; 72/202; 72/234

(58) Field of Search ..... 72/7.1, 7.4, 7.6, 72/8.3, 8.9, 9.1, 9.2, 11.6, 11.7, 11.8, 206, 226, 234, 200, 202

(56) References Cited

U.S. PATENT DOCUMENTS

| | | | | |
|---|---|---|---|---|
| 2,287,380 | | 6/1942 | Klein et al. . | |
| 3,882,709 | | 5/1975 | Kawamoto et al. . | |
| 4,596,608 | | 6/1986 | Shimizu et al. . | |
| 5,054,302 | * | 10/1991 | Yamashita et al. | 72/9.2 |
| 5,197,179 | * | 3/1993 | Sendzimir et al. | 29/527.4 |
| 5,412,966 | * | 5/1995 | Neese et al. | 72/39 |
| 5,609,053 | * | 3/1997 | Ferreira et al. | 72/9.2 |
| 6,079,242 | * | 6/2000 | Allegro et al. | 72/8.6 |

FOREIGN PATENT DOCUMENTS

| | | |
|---|---|---|
| 40 15 750 | 11/1990 | (DE) . |
| 690 02 267 | 11/1993 | (DE) . |
| 0 391 658 | 10/1990 | (EP) . |
| 0 679 451 | 11/1995 | (EP) . |

OTHER PUBLICATIONS

Patent Abstracts of Japan, vol. 010, No. 372 (M–544), Dec. 11, 1986 & JP 61 165206A (Kawasaki Steel Corp.) Jul. 25, 1986.

Patent Abstracts of Japan, vol. 004, No. 139 (M–034), Sep. 30, 1980 & JP 55 094722 A (Nippon Steel Corp.) Jul. 18, 1980.

Patent Abstracts of Japan, vol. 010, No. 365 (M–542) Dec. 6, 1986 & JP 61 159213 A (Nippon Steel Corp.) Jul. 18, 1986.

Bresson et al., "Utilisation de Techniques Neuromimetiques en Laminage a Froid au Skin–Pass de Sollac Floragce" Cahiers D'Informations Techniques de la Revue de Metallurgie, 90 (1993), Jul./Aug. No. 7/8 Listed in the International Search Report.

Eyring et al., "Neubau eines zweigerüstigen Nachwalzwerkes für das Dressieren und Reduzieren von Feinstblech", Fachbericht Walzwerksanlagen, SMS Führend durch Technik English abstract provided.

Schmitz et al., "Entwicklungen der Kaltbandwerke bei der Thyssen Stahl AG", Sep. 11, 1989, Stahl u. Eisen 109 (1989) No. 18 English abstract provided.

* cited by examiner

*Primary Examiner*—Ed Tolan
(74) *Attorney, Agent, or Firm*—Kenyon & Kenyon

(57) ABSTRACT

A process for rolling a metal strip, in particular a steel strip, using a cold-rolling train, which is followed by an annealing section and a temper pass section, the outflow thickness, i.e., the setpoint thickness of the metal strip at the outflow from the cold-rolling train being determined as a function of the setpoint hardness and the setpoint thickness of the metal strip at the outflow from the temper pass section.

16 Claims, 3 Drawing Sheets

PROCESS AND INSTALLATION FOR ROLLING A METAL STRIP

This application is a 35 USC 371 of PCT/DE98/01771 filed Jun. 26, 1998.

BACKGROUND INVENTION

The present invention relates to a method and system for rolling a metal strip using a cold-rolling train, which is followed by an annealing section and a temper pass section. It is difficult to achieve the desired material hardness when working with rolling trains of this type.

SUMMARY

It is an object of the present invention to provide a method and a system by which the desired material hardness may be achieved precisely. In so doing, it is also desirable to achieve the desired value for the thickness of the metal strip at the outflow from the temper pass section.

According to the present invention, the outflow thickness, i.e., the setpoint thickness of the metal strip at the outflow from the cold-rolling train is determined as a function of the setpoint hardness and of the setpoint thickness at the outflow from the temper pass section. In this way, it is possible to achieve the desired setpoint hardness as the rolled strip runs out from the temper pass section. In this context, in one example embodiment of the present invention, the effect of the temper pass section, in particular the relationship between hardness of the metal strip and the degree of thickness reduction of the metal strip, as well as the effect of the annealing section, in particular on the material hardness, are taken into account. According to this embodiment of the present invention, taking into account the reduction in the material hardness in the annealing section, as well as the relationship between the hardness of the metal strip and the degree of thickness reduction of the metal strip in the temper pass section, the thickness of the rolled strip at the outflow from the cold-rolling train is predefined in such a way that, during the thickness reduction of the metal strip in the temper pass section to the desired setpoint thickness of the metal strip, the desired setpoint hardness is also established. According to the present invention, the precision in reaching the desired setpoint hardness of the metal strip at the outflow from the temper pass section can be improved considerably in this manner.

In another example embodiment of the present invention, the effect of the temper pass section, i.e., in particular the relationship between hardness of the metal strip and the degree of thickness reduction of the metal strip, is ascertained from the effect of the cold-rolling train, that is to say, in particular from the relationship between hardness of the metal strip and the degree of thickness reduction of the metal strip in the cold-rolling train. The modeling of the relationship between the degree of thickness reduction of the metal strip and material hardness is effected on the basis of the relationships between the degree of thickness reduction of the metal strip and material hardness at the roll stands of the cold-rolling train or at several selected roll stands of the cold-rolling train.

In another example embodiment of the present invention, the effect of the temper pass section, in particular the relationship between hardness of the metal strip and the degree of thickness reduction of the metal strip, is determined in advance, in particular by use of tensile tests.

In another example embodiment of the present invention, the ascertained effect of the temper pass section, in particular the ascertained relationship between hardness of the metal strip and the degree of thickness reduction of the metal strip, is corrected by comparing a measured value of the actual hardness with the setpoint hardness of the metal strip at the outflow from the temper pass section, along the lines of reducing the deviation between the setpoint hardness and the measured value of the actual hardness of the metal strip at the outflow from the temper pass section.

In another example embodiment, the setpoint value for the thickness, i.e., the setpoint thickness of the metal strip at the outflow from the cold-rolling train, ascertained from the effect of the temper pass section, in particular from the relationship between hardness of the metal strip and the degree of thickness reduction of the metal strip, is corrected by comparing the actual hardness and the setpoint hardness of the metal strip at the outflow from the temper pass section, along the lines of reducing the deviation between the setpoint hardness and the actual hardness of the metal strip at the outflow from the temper pass section.

Using these measures relating to precise modeling of the relationship between hardness of the metal strip and the degree of thickness reduction of the metal strip, the desired setpoint hardness is achieved particularly well. If no measured values for the hardness of the metal strip at the outflow from the temper pass section are available, then the actual values are advantageously ascertained by inverse modeling. The method according to the present invention is used particularly advantageously in achieving a constant material hardness over the entire length of the metal strip, thereby preventing scrap to a great extent.

In an advantageous embodiment of the present invention, the thickness of the metal strip is reduced by at least 10%, in particular by at least 20%, in the temper pass section. Furthermore, it is particularly advantageous to reduce the thickness of the metal strip by 20 to 40% in the temper pass section.

DETAILED DESCRIPTION

Figure 1:
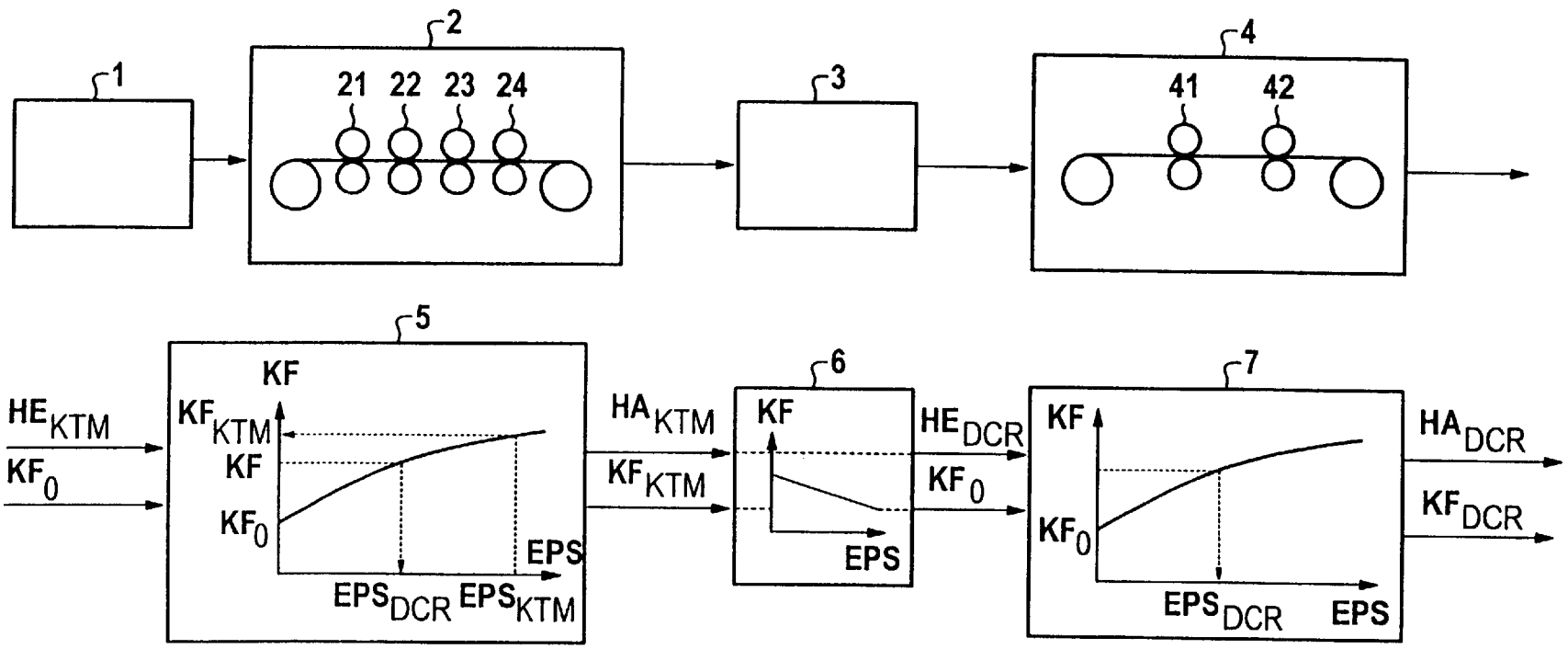
FIG. 1 shows a rolling train according to the invention.

FIG. 1 shows a rolling train for implementing an example embodiment of the present invention. A cold-rolling train 2 having, by way of example, four roll stands 21, 22, 23, 24 is followed by an annealing section 3 and a temper pass section 4. A metal strip, which, for example, runs out of a hot-rolling train 1, runs into cold-rolling train 2 in the exemplary embodiment according to FIG. 1, and is further reduced. It is then annealed in annealing section 3 and temper-rolled in temper pass section 4 and, according to the present invention, its thickness is reduced. The relationships, illustrated in functional blocks 5, 6 and 7, show the change in the material hardness in cold-rolling train 2, in annealing section 3 and in temper pass section 4. A metal strip with the thickness $HE_{KTM}$ and the hardness $KF_0$ runs into cold-rolling train 2, and runs out of cold-rolling train 2 with the thickness $HA_{KTM}$ and the hardness $KF_{KTM}$. Functional block 5 shows the physical relationship between material hardness KF and the degree of thickness reduction EPS of the metal strip. In this case, the degree of thickness reduction EPS is defined as $$EPS = 1 - \frac{HE}{HA}$$

where HE is the inflow thickness and HA is the outflow thickness of the metal strip. In annealing section 3, material hardness KF decreases as a function of the thickness reduction of the metal strip in the cold-rolling train, as functional block 6 shows. In this context, the material thickness remains unchanged, i.e., $HA_{KTM}=HE_{DCR}$. After passing through annealing section 3, the metal strip has the material hardness $KF_0$. In the present exemplary embodiment, temper pass section 4 has two roll stands 41 and 42. In one example embodiment of the present invention, the rolled strip is reduced by first roll stand 41. The desired surface properties and flatness of the rolled strip are achieved by second roll stand 42. The rolled strip, which runs with strip thickness $HE_{DCR}$ and material hardness $KF_0$ into temper pass section 4, runs out with strip thickness $HA_{DCR}$ and material hardness $KF_{DCR}$, as functional block 7 shows. According to the method of the present invention, the pair of values $HA_{KTM}$ and $KF_{KTM}$ is set, in conformance with the relationships according to functional blocks 6 and 7, in such a way that the desired values for outflow thickness $HA_{DCR}$ and material hardness $KF_{DCR}$ are achieved by the thickness reduction in temper pass section 4. If, for example, a rolled strip has the thickness $HE_{KTM}$ of 4 mm and the hardness $KF_0$ of 300 $N/mm^2$ at the entry to the cold-rolling train, and if the desired thickness $HA_{DCR}$ of the metal strip is 0.3 mm and the desired hardness $KF_{DCR}$ of the metal strip is 450 $N/mm^2$, then for one exemplary configuration, the metal strip is to be rolled in cold-rolling train 3 in such a way that $HA_{KTM}$=0.5 mm and $KF_{KTM}$=600 $N/mm^2$. In subsequent annealing section 3, the hardness of the metal strip is in turn reduced to the hardness $KF_0$, i.e., 300 $N/mm^2$. As a result of the subsequent reduction of the metal strip in temper pass section 4 from an inflow thickness $HE_{DCR}$ of 0.5 mm to an outflow thickness $HA_{DCR}$ of 0.3 mm, the hardness $KF_{DCR}$ of the metal strip at the outflow from temper pass section 4 is increased to the desired 450 $N/mm^2$. The limits of the process according to the invention depend upon the possible reduction in temper pass section 4. If, for example, $HE_{KTM}$=4 mm
$HA_{DCR}$=0.3 mm
KFO=300 $N/mm^2$
KFI=350 $N/mm^2$
KFE=0.7, then, given the reduction variation in the temper pass section of 10 . . . 40%, a hardness variation of about 35% can be achieved. For this case, a variation of entry thickness $HE_{DCR}$ into temper pass section 4 from 0.33 to 0.5 mm is possible. This variation permits a change in material strength $KF_{DCR}$ from 330 $N/mm^2$ to 440 $N/mm^2$.

Figure 2:
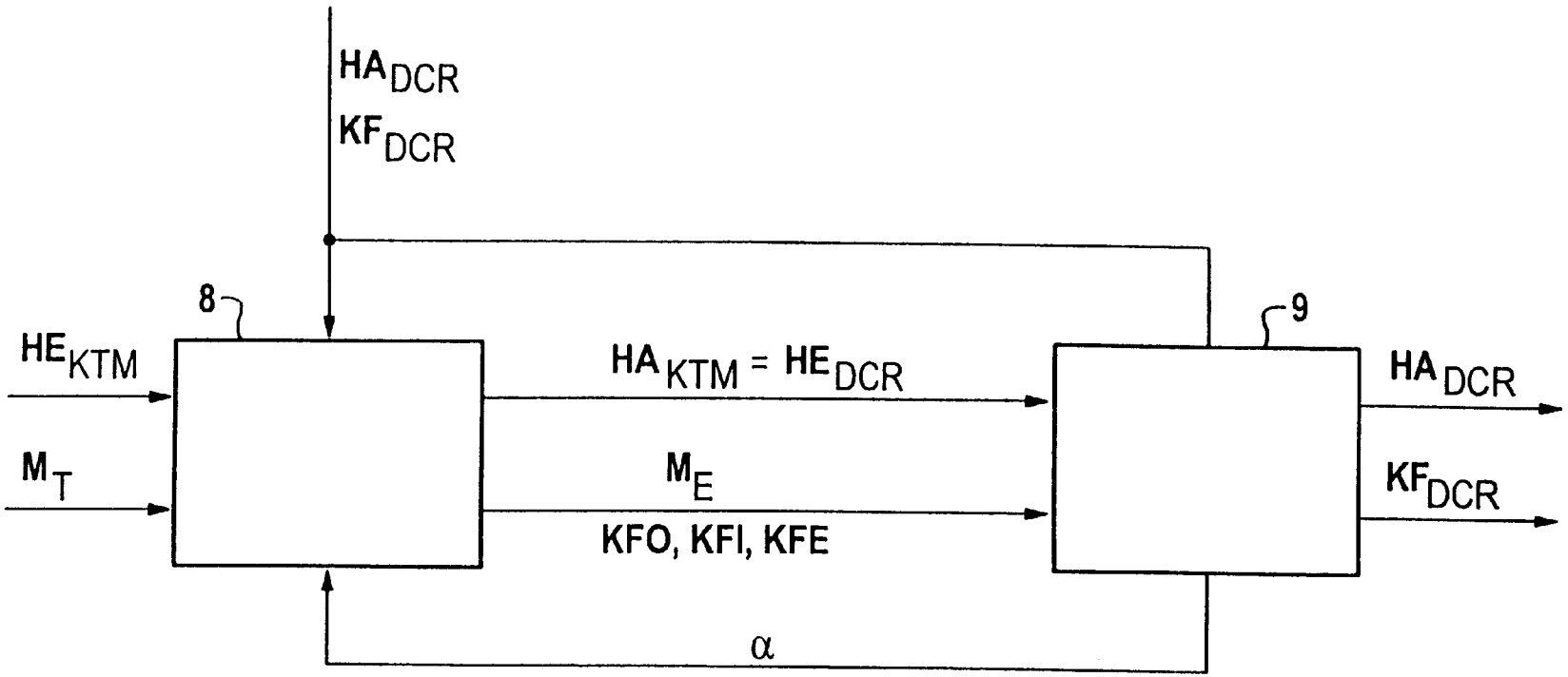
FIG. 2 shows the determination of a correction factor according to the present invention.

The modeling according to the present invention, illustrated in functional blocks 5 and 7, is taken into consideration. Furthermore, it may be advantageous to transfer the model for the relationship between material hardness KF and the degree of thickness reduction EPS for the cold-rolling train to temper pass section 4, as well. In this case, the relationship, ascertained for the cold-rolling train, between hardness KF of the metal strip and the degree of thickness reduction EPS of the metal strip is particularly advantageously corrected by comparing the actual hardness and the setpoint hardness at the outflow of the metal strip from temper pass section 4, along the lines of reducing the deviation between the setpoint hardness and the actual hardness at the outflow from temper pass section 4. A correction of this type is shown by FIG. 2. The setting of the material strength in the temper pass section can be carried out in accordance with the following automation stages:

1. Pre-control 8 by calculating and rolling an outflow thickness $HA_{KTM}$ in the cold-rolling train in accordance with the setpoint value for hardness $HKF_{DCR}$ and thickness $HA_{DCR}$ of the metal strip after temper pass section 4.
2. Feedback 9 by ascertaining achieved hardness $KF_{DCR}$ in temper pass section 4 and forming a correction value $\alpha$ for thickness $HA_{KTM}$ of the metal strip at the outflow from cold-rolling train 2 in accordance with the deviations from the setpoint value for $KF_{DCR}$.
3. Ascertaining the material strength curve, i.e., the relationship between hardness KF of the metal strip and thickness reduction EPS, in cold-rolling train 2 over the length of the strip, and calculating and rolling the strip thickness $HA_{KTM}$ over the length of the strip in accordance with the ascertained material strength curve and the setpoint value for hardness $KF_{DCR}$ of the metal strip.

In detail, outflow thickness $HA_{KTM}$ of the metal strip is calculated in pre-control 8 in accordance with desired hardness $KF_{DCR}$ Of the metal strip. This is carried out as a function of the thickness $HA_{DCR}$ of the metal strip at the outflow from the temper pass section, the hardness $KF_{DCR}$ of the metal strip at the outflow from the temper pass section, the thickness $HE_{KTM}$ of the metal strip at the inflow into the cold-rolling train, and of material properties $M_T$ of the rolled strip. The starting variables for pre-control 8 are thickness $HA_{KTM}$ of the metal strip at the outflow from the cold-rolling train, and material parameters $M_E$ of the metal strip. These material parameters $M_E$ are essentially parameters which describe the hardness $KF_{DCR}$ of the metal strip. In the present example, they are parameters KFO, KFI and KFE, which describe the relationship between hardness $KF_{DCR}$ of the metal strip and the degree of thickness reduction of the metal strip. Depending on the actual values for thickness $HA_{DCR}$ and hardness $KF_{DCR}$ of the metal strip, feedback 9 ascertains a correction value $\alpha$, with which the value for thickness $HA_{KTM}$ of the metal strip at the outflow from the cold-rolling train is corrected. It may be particularly advantageous to multiply the correction parameter a and the desired thickness $HA_{KTM}$ of the metal strip at the outflow from the cold-rolling train. The correction parameter a is formed in such a way that the deviation between actual thickness $HA_{DCR}$ of the metal strip at the outflow from the temper pass section and the corresponding setpoint value is minimized.

A higher strength of the ends of the strip is yielded by cooling off the outer and inner windings after the hot-rolling train more rapidly. Even intermediate annealing after the cold-rolling train is not able to eliminate this effect, as is shown by the curve 13 in FIG. 3, which illustrates the characteristic of hardness $KF_0$ of the metal strip over the length BL of the metal strip. Particularly when working with deep-drawing material, these ends must generally be cut off after the temper rolling, since hardness $KF_{DCR}$ of the metal strip is intended to be constant over the length of the strip. In this context, the high proportion of scrap and the additional outlay lead to a high cost burden. Increases of up to 15% in material hardness occur. This increase in material hardness decreases gradually over a strip length of about 50 m. Given an increase in material hardness of 15%, according to the invention, the reduction $EPS_{DCR}$ in the temper pass section is reduced by about 15%. This takes place particularly advantageously if the overall reduction $EPS_{DCR}$ is greater than 30%. In the case of the example cited above, a 15% change in the reduction means a change in the entry thickness of 50 $\mu$m or 6%.

Figure 3:
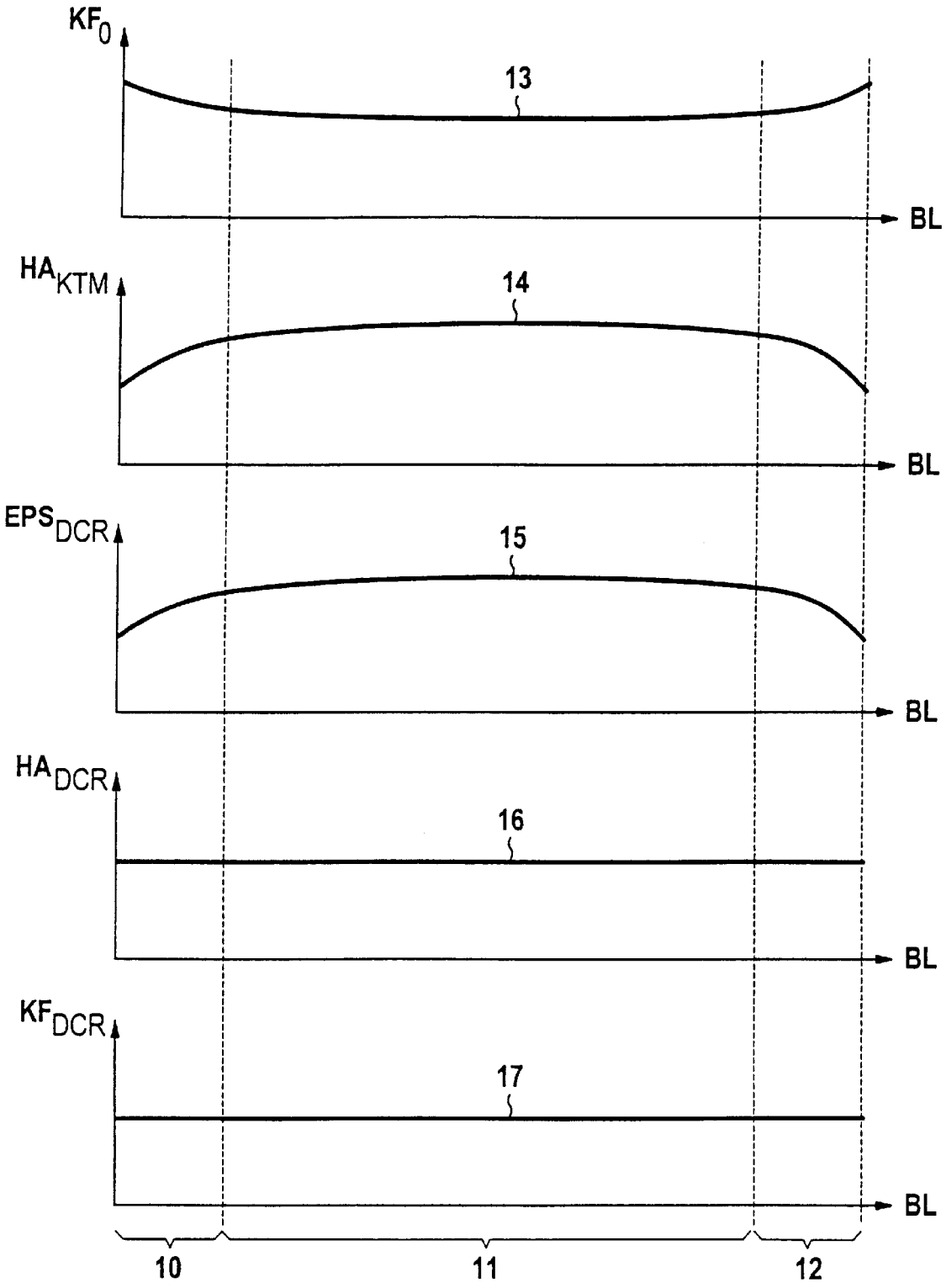
FIG. 3 shows a process for achieving a constant hardness over the length of the metal strip.

The curves 13, 14, 15, 16 and 17 in FIG. 3 illustrate the use of the process according to the invention for achieving a constant hardness KF over the length of the metal strip. At the outflow from the cold-rolling train, the metal strip has a hardness $KF_0$ corresponding to curve 13. At the ends of the strip, that is to say in regions 10 and 12, the metal strip exhibits a greater hardness than in the middle region. Regions 10 and 12 may include, for example, a strip length of 50 m each. According to the present invention, the cold-rolling train is adjusted in such a way that the metal strip at the outflow from the cold-rolling train has a thickness corresponding to curve 14. The characteristic of curve 14 is selected such that, given a thickness reduction $EPS_{DCR}$ in the temper pass section, as shown by curve 15, a constant characteristic of thickness $HA_{DCR}$ and of hardness $KF_{DCR}$ of the metal strip is established, according to curves 16 and 17.

What is claimed is:

1. A method for rolling a metal strip, comprising:

arranging a cold-rolling train upstream from an annealing section and a temper pass section;

determining hardness and thickness setpoint values of the metal strip at an outflow from the temper pass section; and determining a setpoint thickness of the metal strip at an outflow from the cold-rolling train as a function of the setpoint values for the hardness and thickness setpoint values of the metal strip at the outflow from the temper pass section.

2. The method according to claim 1, wherein the metal strip is a steel strip.

3. The method according to claim 1, further comprising:

providing a rolling model of the temper pass section, the setpoint thickness of the metal strip being determined as a function of an effect of the temper pass section using the rolling model.

4. The method according to claim 3, further comprising:

modeling a relationship between a hardness of the metal strip and a degree of thickness reduction of the metal strip using the rolling model of the temper pass section.

5. The method according to claim 1, further comprising:

providing a model of the annealing section, the setpoint thickness of the metal strip at the outflow from the cold-rolling train being determined as a function of an effect of the annealing section using the model of the annealing section.

6. The method according to claim 3, further comprising:

determining the effect of the temper pass section as a function of an effect of the cold-rolling train, the effect of the temper pass section including a relationship between the hardness of the metal strip and a degree of thickness reduction of the metal strip, the effect of the temper pass section including one of: i) a relationship between the hardness of the metal strip and a degree of thickness reduction of the metal strip at roll stands, and ii) a selection of roll stands of the cold-rolling train.

7. The method according to claim 3, further comprising:

determining the effect of the temper pass section in advance by tensile tests, the effect of the temper pass section including a relationship between the hardness of the metal strip and a degree of thickness reduction of the metal strip.

8. The method according claim 7, further comprising:

correcting the determined effect of the temper pass section by comparing a measured value of an actual harness and the setpoint hardness of the metal strip at the outflow from the temper pass section and reducing a deviation between the setpoint-hardness and the measured value of the actual hardness.

9. The method according to claim 3, further comprising:

determining the setpoint thickness of the metal strip at the outflow from the cold-rolling train as a function of an effect of the temper pass section, the effect of the temper pass section including a relationship between a hardness of the metal strip and a degree of thickness reduction of the metal strip; and correcting the setpoint thickness by comparing an actual hardness and the setpoint hardness of the metal strip at the outflow from the temper pass section by reducing a deviation between the setpoint hardness of the metal strip at the outflow from the temper pass section and the actual hardness of the metal strip at the outflow from the temper pass section.

10. The method according to claim 1, wherein the metal strip has a length, and wherein the hardness of the metal strip at the outflow from the temper pass is kept constant over the length of the metal strip.

11. The method according to claim 1, wherein the temper pass section includes at least two roll stands, the method further comprising:

reducing the thickness of the metal strip using at least one of the roll stands; and adjusting flatness and influencing a surface of the metal strip using at least another of the roll stands.

12. The method according to claim 11, wherein the at least one of the roll stands is a first one of the roll stands, and the at least another of the roll stands is a second one of the roll stands.

13. The method according to claim 1, further comprising:

reducing the thickness of the metal strip by at least 10% in the temper pass section.

14. The method according to claim 13, wherein the thickness of the metal strip is reduced by at least 20% in the temper pass section.

15. The method 14, wherein the thickness of the metal strip is reduced by between 20% and 40% in the temper pass section.

16. A system for rolling a metal strip, comprising:

an annealing section and a temper pass section;

a cold-rolling train arranged upstream from the annealing section and the temper pass section; and a computing device determining a setpoint thickness of the metal strip at the outflow from the rolling train as a function of a setpoint hardness and a setpoint thickness at an outflow from the temper pass section.

* * * * *